US005370952A

United States Patent [19]

Datta et al.

[11] Patent Number: 5,370,952

[45] Date of Patent: Dec. 6, 1994

[54] ORGANIC CONDUCTOR FOR AN ELECTROPHOTOGRAPHIC SCREENING PROCESS FOR A CRT

[75] Inventors: Pabitra Datta, Cranbury; Nitin V. DeSai, Princeton; Ronald N. Friel, Hamilton Square; Eugene S. Poliniak, Willingboro, all of N.J.

[73] Assignee: RCA Thomson Licensing Corp., Princeton, N.J.

[21] Appl. No.: 168,485

[22] Filed: Dec. 22, 1993

[51] Int. Cl.[5] ..... G03C 5/00

[52] U.S. Cl. ..... 430/28; 430/23; 430/29

[58] Field of Search ..... 430/28, 23, 29

[56] References Cited

U.S. PATENT DOCUMENTS 3,558,310 1/1971 Mayaud ..... 96/36.1
4,508,805 4/1985 Kawamura et al. ..... 430/72
4,921,767 5/1990 Datta et al. ..... 430/23
5,083,959 1/1992 Datta et al. ..... 445/52
5,229,234 7/1993 Riddle et al. ..... 430/28
5,240,798 8/1993 Ehemann, Jr. ..... 430/23

*Primary Examiner*—Steve Rosasco
*Attorney, Agent, or Firm*—Joseph S. Tripoli; Dennis H. Irlbeck; Vincent J. Coughlin, Jr.

[57] ABSTRACT

The method of electrophotographically manufacturing a screen assembly on an interior surface of a faceplate panel for a color CRT, according to the present invention, includes the steps of sequentially coating the surface of the panel with a conductive solution to form a volatilizable organic conductive layer and then overcoating the conductive layer with a photoconductive solution to form a volatilizable organic photoconductive layer. The conductive layer, comprising a quaternary ammonium polyelectrolyte and a surfactant, provides an electrode for the photoconductive layer and has improved electrical and physical properties compared to prior conductive layers.

4 Claims, 4 Drawing Sheets

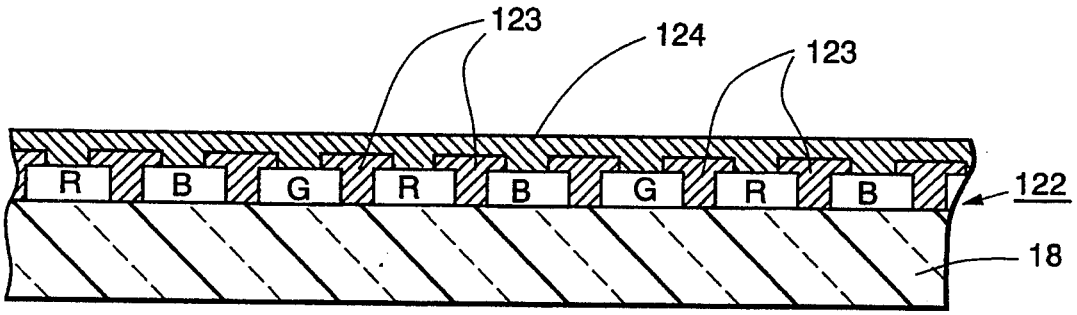
Fig. 5
Fig. 6
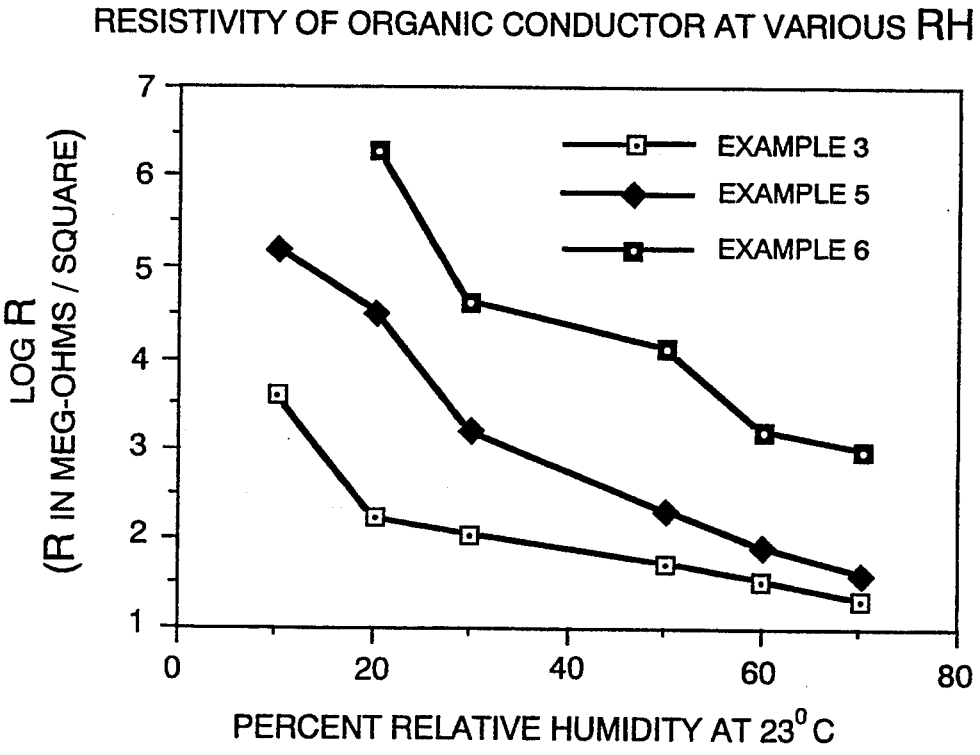

ORGANIC CONDUCTOR FOR AN ELECTROPHOTOGRAPHIC SCREENING PROCESS FOR A CRT

The invention relates to a method of electrophotographically manufacturing a luminescent screen assembly for a cathode-ray tube (CRT) and, more particularly, to a method in which improved materials are used to provide an organic conductive layer which acts as an electrode for an overlying photoconductive layer. The improved conductive layer has superior physical and electrical properties compared to prior conductive layers.

BACKGROUND OF THE INVENTION

Datta et al. U.S. Pat. No. 4,921,767, issued on May 1, 1990, describes a method for electrophotographically manufacturing a luminescent screen assembly on an interior surface of a CRT faceplate using dry-powdered, triboelectrically charged, screen structure materials deposited on a suitably prepared, electrostatically chargeable surface. The chargeable surface, or photoreceptor, comprises an organic photoconductive layer overlying a conductive layer, both of which are deposited, serially, as solutions on the interior surface of the CRT panel.

The conductive layer of the aforementioned patent comprises either an inorganic conductor, such as tin oxide, indium oxide, or a mixture of indium-tin oxide, or, a volatilizable organic conductive material consisting of a polyelectrolyte commercially known as Polybrene, available from Aldrich Chemical Co., Milwaukee, Wis. A drawback of the latter mentioned material is that it possesses high surface resistivity ($\geqq 10^{11}$ ohms/square) which results in slow and non-uniform charging of the overlying photoconductive layer at low relative humidity (<50% RH). Also, it tends to crack during filming, and is prone to crystallize causing defects in the screen assembly.

A need exists for suitable materials that overcome the above-mentioned shortcomings of the latter mentioned known material and which are inexpensive and compatible with the photoconductive layer.

SUMMARY OF THE INVENTION

In accordance with the present invention, a method of electrophotographically manufacturing a luminescent screen assembly on an interior surface of a faceplate panel of a color CRT includes the steps of coating the surface of the panel with a conductive solution comprising a quaternary ammonium polyelectrolyte and a surfactant to form a volatilizable organic conductive layer and overcoating the organic conductive layer with a photoconductive solution to form a volatilizable organic photoconductive layer. The quaternary ammonium polyelectrolyte is selected from the group consisting of poly(dimethyl-diallyl-ammonium chloride), poly(3,4-dimethylene-N-dimethyl pyrrolidium chloride) (3,4-DNDP chloride), poly (3,4-dimethylene-N-dimethyl pyrrolidium nitrate) (3,4-DNDP nitrate), poly(3,4-dimethylene-N-dimethyl pyrrolidium phosphate)(3,4-DNDP phosphate), and a copolymer of vinylimidazolium methosulfate and vinylpyrrolidone.

CROSS REFERENCE TO RELATED APPLICATIONS

This application can be used with the inventions described in copending applications entitled, "Organic Photoconductor For An Electrophotographic Screening Process For A CRT" and "Method For Combined Bake-Out And Sealing Of An Electrophotographically Processed Screen Assembly For A Cathode Ray Tube", filed concurrently herewith.

BRIEF DESCRIPTION OF THE DRAWINGS

FIG. 5 is an alternative embodiment of a screen assembly of the tube shown in FIG. 1.

FIG. 6 is a graph of the resistivity of various conductor layers as a function of percent relative humidity.

DETAILED DESCRIPTION OF THE PREFERRED EMBODIMENT

Figure 1:
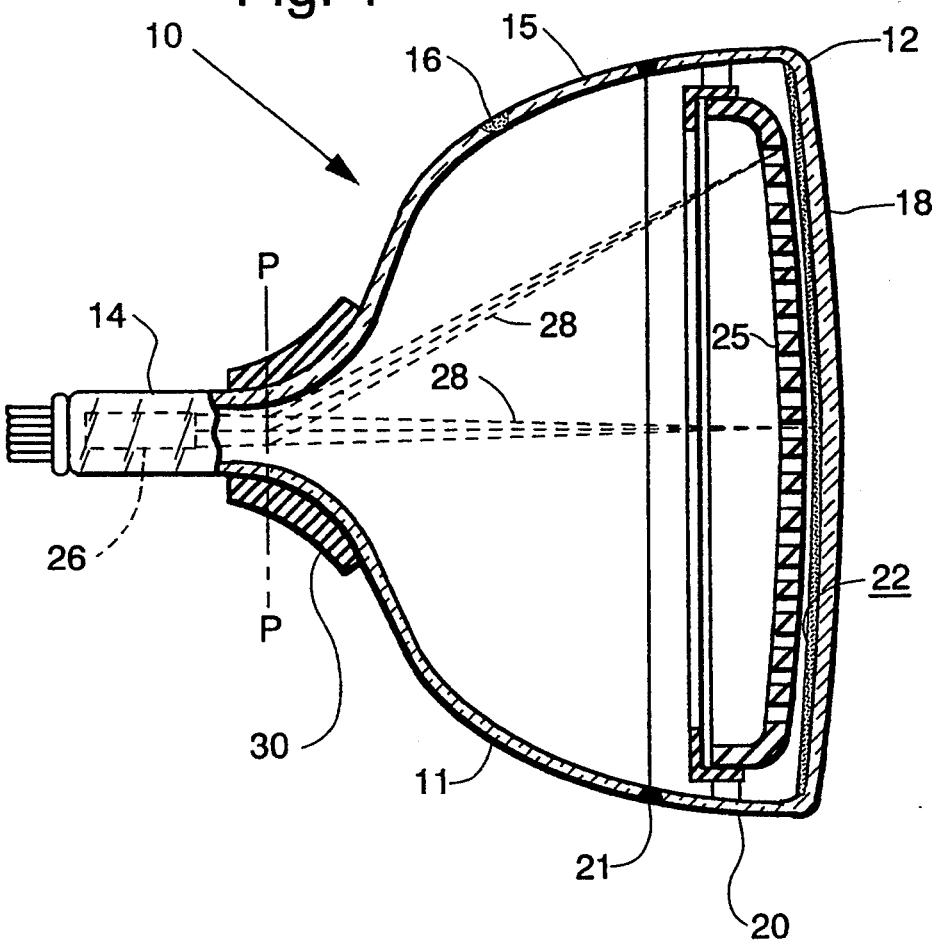
FIG. 1 is a plan view, partially in axial section, of a color CRT made according to the present invention.
Figure 2:
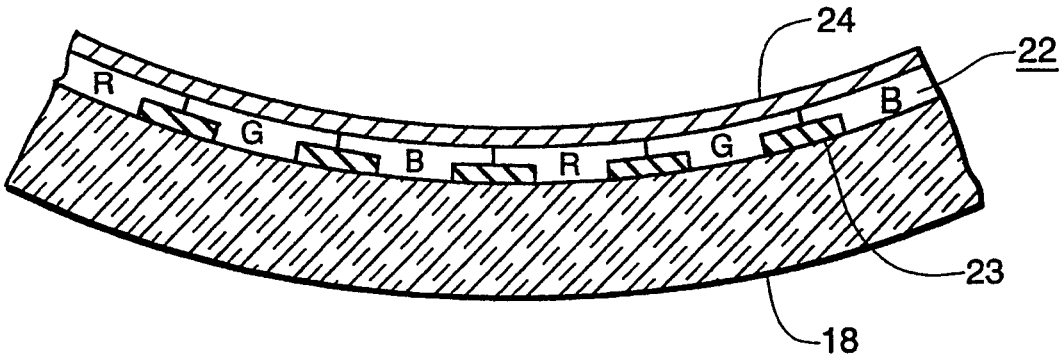
FIG. 2 is a section of a screen assembly of the tube shown in FIG. 1.

FIG. 1 shows a color display device, such as a CRT, 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color luminescent screen 22 is carried on the interior surface of the faceplate 18. The screen 22, shown in FIG. 2, preferably is a line screen which includes a multiplicity of screen elements comprised of red-emitting, green-emitting and blue-emitting phosphor stripes, R, G and B, respectively, arranged in color groups or picture elements of three stripes, or triads, in a cyclic order and extending in a direction which is generally normal to the plane in which impinging electron beams are generated. In the normal viewing position for this embodiment, the phosphor stripes extend in the vertical direction. Preferably, the phosphor stripes are separated from each other by a light-absorptive matrix material 23, as is known in the art. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 18. The screen 22 and the overlying aluminum layer 24 comprise a screen assembly.

Again with respect to FIG. 1, a multi-apertured color selection electrode, or shadow mask, 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths through the apertures in the mask 25 to the screen 22.

The gun 26 may, for example, comprise a bi-potential electron gun of the type described in Morrell et al. U.S. Pat. No. 4,620,133, issued on Oct. 28, 1986, or any other suitable gun.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1, at about the middle of the yoke 30. For simplicity, the actual curvature of the deflection beam paths in the deflection zone is not shown.

Figure 4:
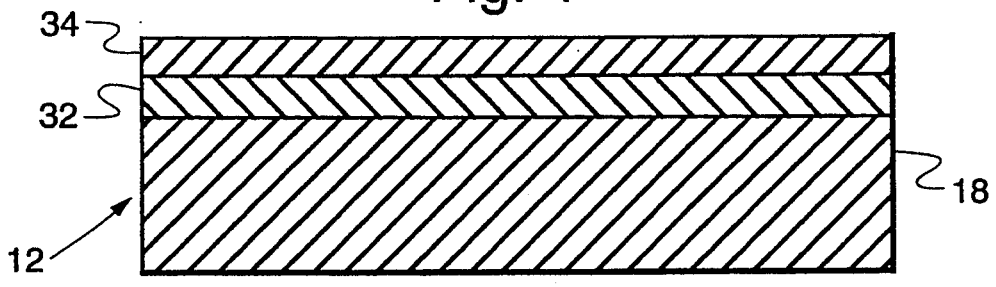
FIG. 4 is a section of a faceplate panel showing a photoconductive layer overlying the present conductive layer.
Figure 3:
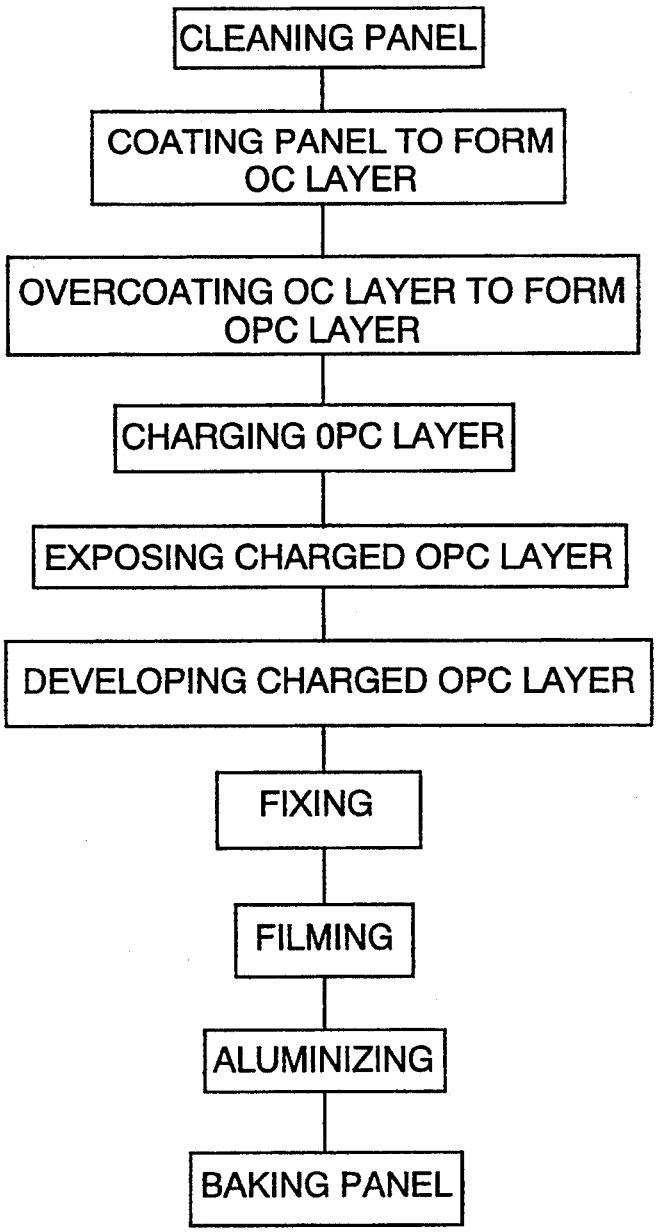
FIG. 3 is a block diagram of the processing sequence utilized in the electrophotographic screening process.

The screen 22 is manufactured by the electrophotographic screening (EPS) process that is described in U.S. Pat. No. 4,921,767, cited above, and shown in block diagram in FIG. 3. Initially, the panel 12 is washed with a caustic solution, rinsed in water, etched with buffered hydrofluoric acid and rinsed again with water, as is known in the art. The interior of the viewing faceplate 18 is then provided with a photoreceptor comprising a suitable layer 32, preferably, of an organic conductive (OC) material which provides an electrode for an overlying organic photoconductive (OPC) layer 34. The OC layer 32 and the OPC layer 34 are shown in FIG. 4.

In order to form the matrix by the EPS process, the OPC layer 34 is charged to a suitable potential within the range of +200 to +700 volts using a corona charger of the type described in Datta et al. U.S. Pat. No. 5,083,959, issued on Jan. 28, 1992. The shadow mask 25 is inserted into the panel 12 and the positively charged OPC layer 34 is exposed, through the shadow mask 25, to actinic radiation, such as light from a xenon flash lamp disposed within a conventional three-in-one lighthouse. After each exposure, the lamp is moved to a different position to duplicate the incident angle of the electron beams from the electron gun. Three exposures are required, from the three different lamp positions, to discharge the areas of the OPC layer where the light-emitting phosphors subsequently will be deposited to form the screen 22. After the exposure step, the shadow mask 25 is removed from the panel 12 and the panel is moved to a first developer, such as that described in co-pending U.S. patent application Ser. No. 132,263, filed on Oct. 6, 1993. The developer contains suitably prepared dry-powdered particles of a light-absorptive black matrix screen structure material. The matrix material is triboelectrically negatively charged by the developer. The negatively charged matrix material may be directly deposited in a single step as described in U.S. Pat. No. 4,921,767, or it may be directly deposited in two steps as described in Riddle et al. U.S. Pat. No. 5,229,234, issued on Jul. 20, 1993. The "two step" matrix deposition process increases the opacity of the resultant matrix. The light emitting phosphor materials are then deposited in the manner described in U.S. Pat. No. 4,921,767.

It also is possible to form a matrix using a conventional wet matrix process of the type known in the art and described, for example, in Mayaud U.S. Pat. No. 3,558,310, issued on Jan. 26, 1971. If the matrix is formed by the wet process, then the photoreceptor is formed on the matrix and the phosphor materials are deposited in the manner described in U.S. Pat. No. 4,921,767.

As an alternative to both of the above-described "matrix first" processes, a matrix 123 can be electrophotographically formed after the phosphors are deposited by the EPS process. This "matrix last" process is described in Ehemann, Jr., U.S. Pat. No. 5,240,798, issued on Aug. 31, 1993. FIG. 5 shows a screen assembly comprising a screen 122 and an overlying aluminum layer 124 made according to the "matrix last" process of U.S. Pat. No. 5,240,798.

In the "matrix last" process, the red-, blue-, and green-emitting phosphor elements, R, B and G, respectively, are formed by serially depositing triboelectrically positively charged particles of phosphor screen structure material onto a positively charged OPC layer 34 of the photoreceptor. The charging process is the same as that described above and in U.S. Pat. No. 5,083,959. After the three phosphors are deposited, the OPC layer 34 is again uniformly charged to a positive potential and the panel, containing the aforedeposited phosphor materials is disposed on a matrix developer which provides a triboelectrically negative charge to the matrix screen structure material. The positively charged open areas of the photoconductive layer, separating the phosphor screen elements, are directly developed by depositing onto the open areas the negatively charged matrix materials to form the matrix 123. This process is called "direct" development. The screen structure materials are then fixed and filmed as described in U.S. Pat. No. 4,921,767. The aluminum layer 124 is provided on the screen 122 for the purpose described above for the deposition of layer 24. The faceplate panel with the aluminized screen assembly is then baked at about 425° C. to volatilize the constituents of the screen assembly. It should be appreciated that the screen making process described above, can be modified by reversing both the polarity of the charge provided on the OPC layer 34 and the polarity of the triboelectric charge induced on the screen structure materials to achieve a screen assembly identical in structure to that described above.

Again with reference to FIG. 4, the OC layer 32 is formed by coating the interior surface of the panel 12 with an aqueous organic conductive solution comprising 2 to 6 weight percent (wt. %) of a quaternary ammonium polyelectrolyte, about 0.001 to 0.1, but preferably about 0.01 wt. % of a suitable surfactant, about 0.5 to 2 wt. %, or less, polyvinyl alcohol (PVA), and the balance deionized water. In the case of a copolymer formulation, the conductive solution comprises 5 wt. % of an electrolyte, 0.05 wt. % of a surfactant, and the balance deionized water. The quaternary ammonium polyelectrolyte is a homopolymer selected from the group consisting of poly (dimethyl-diallyl-ammonium chloride); poly(3,4-dimethylene-N-dimethyl-pyrrolidium chloride)(3,4-DNDP chloride); poly(3,4-dimethylene-N-dimethyl-pyrrolidium nitrate)(3,4-DNDP nitrate); and poly (3,4-dimethylene-N-dimethyl-pyrrolidium phosphate) (3,4-DNDP phosphate). Alternatively, a suitable copolymer, such as vinylimidazolium methosulfate (VIM) and vinylpyrrolidone (VP) may be used in the conductive solution.

Poly(dimethyl-diallyl-ammonium chloride) is available commercially from the Calgon Corp., Pittsburgh, Pa., as Cat-Floc-C or Cat-Floc-T-2, and the copolymer of VIM and VP is available as MS-905, from BASF Corp., Persippany, N.J. The commercially available Cat-Floc materials contain 0.6 wt. % polyelectrolyte, 0.3 wt. % polyvinylpyrrolidone, and about 99 wt. % methylalcohol, as well as inorganic salts, such as NaCl and $K_2SO_4$ which do not bake out completely after panel bake. The chloride ion must be removed, or at least reduced in concentration, from the purchased materials before they can be used to make the organic conductor. The commercially available material costs about $0.20 per 100 g or about $0.002 per panel.

To remove the chloride ion bound to the organic polymer chain of the Cat-Floc material, a ten percent (10%) solution of Cat-Floc is dissolved in triple distilled water and mixed with ten percent (10%) solid anion exchange beads for two hours. The mixture is then filtered through a 5μ pressure filter and the Cat-Floc from the ion exchange is precipated from the solution with acetone. The precipitate is then washed with acetone:water, in a ratio of 80:20, and dissolved in water to make an aqueous solution containing 50 weight % of Cat-Floc. The pH of the chloride-free Cat-Floc is within the range of 12–13. The pH is adjusted to a pH of 4 by titration with 0.1% $HNO_3$ or 0.1% $H_3PO_4$.

The following examples are meant to illustrate the OC layer 32 in greater detail, but not to limit it in any way.

OC EXAMPLE 1

An organic conductor solution is formed by mixing the following ingredients thoroughly for one hour and filtering the solution through a 1 micron (μ) filter. The viscosity of the solution is 2.6 centipose (cp).

100 g (5 wt. %) of a 50% solution, in water, of Poly(-dimethyl-diallyl-ammonium chloride);
2 g (0.01 wt. %) of a surfactant, such as Pluronic L-72 (5% in water: methanol, 50:50) (available from BASF, Persippany, N.J.; and
900 g (balance) deionized water.

OC EXAMPLE 2

A second organic conductor solution is formed by mixing and filtering the following ingredients in the manner described in OC Example 1. The solution has a viscosity of 5 cp.

60 g (3.2 wt. %) of a 50% solution, in water, of Poly(-dimethyl-diallyl-ammonium chloride);
90 g (0.96 wt. %) of a 10% solution, in water, of polyvinyl alcohol (PVA);
2 g (0.01 wt. %) of a 5% solution, in methanol (50): water (50), of Pluronic L-72: and
778 g (balance) deionized water.

OC EXAMPLE 3

A third organic conductor solution is formed by mixing and filtering the following ingredients in the manner described in OC Example 1. The viscosity of the solution is 3 cp.

100 g (5.3 wt. %) of a 50% solution, in water, of Poly (3,4-DNDP chloride);
2 g (0.01 wt. %) of a 5% solution, in methanol (50):water (50), of Pluronic L-72: and
778 g (balance) deionized water.

The same amount of poly (3,4-DNDP nitrate) or poly (3,4-DNDP phosphate) may be substituted in the above solution for the poly (3,4-DNDP chloride).

OC EXAMPLE 4

A fourth organic conductor solution is formed by mixing and filtering the following ingredients in the manner described in OC Example 1. The viscosity of the solution is 1.9 cp.

100 g (5 wt. %) of a 50% solution, in water, of Cat-Floc-C;
2 g (0.01 wt. %) of a 5% solution, in methanol (50): water (50), of Pluronic L-72; and
900 g (balance) deionized water.

OC EXAMPLE 5

A fifth example of an organic conductive solution is formed by mixing and filtering the following ingredients as described in OC Example 1. The viscosity of the solution is 2.6 cp.

60 g (3.2 wt. %) of a 50% solution, in water, of Cat-Floc-C;
90 g (0.96 wt. %) of a 10% solution, in water, of PVA;
2 g (0.01 wt. %) of a 5% solution, in methanol (50): water (50) of Pluronic L-72: and
778 g (balance) deionized water.

OC EXAMPLE 6

The following organic conductor solution is disclosed in U.S. Pat. No. 4,921,767, cited above, and is utilized as a control. The viscosity of the solution is 2.2 cp.

60 g (3 wt. %) of the ionene polymer 1,5 dimethyl-1, 5-dimethyldiazo-undeca-methylene-polymethobromide (available as Polybrene from Aldrich Chem. Co., Milwaukee, Wis.);
120 g (1.5 wt. %) of a 25% solution, in water, of polyacrylic acid (PAA);
1.5 g (0.004 wt. %) of a 5% solution, in methanol (50): water(50) of Pluronic L-72; and
1812 g (balance) deionized water.

OC EXAMPLE 7

100 g (5 wt. %) of MS-905 copolymer of vinylimidazolium methosulfate (VIM) and vinylpyrrolidone (VP);
3 g (0.01 wt. %) of a 5% solution, in methanol (50): water (50) of Pluoronic L-72; and
900 g (balance) deionized water.

Resistivity as a function of relative humidity was determined for the OC Examples given above. The solutions were coated onto glass slides. Coating thicknesses of 0.5, 1 and 2μ were produced and an ASTM-D 257 surface resistance measuring probe was used to determine the dc volume and surface resistance of the conductive films. The coated glass slides were stored for 24 hours at 5, 20, 30, 50, 60 and 90 percent relative humidity. Surface resistivity of all film samples was found to be independent of the film thickness, but dependent on the relative humidity. Table 1 lists the resistivity, in ohms/square, of films made from the six OC film examples, at 50% relative humidity (RH).

TABLE I

| OC Identification | Resistivity Ohms/sq |
|---|---|
| Example 1 | $5 \times 10^7$ |
| Example 2 | $6 \times 10^8$ |
| Example 3 | $1.8 \times 10^7$ |
| Example 4 | $4 \times 10^7$ |
| Example 5 | $3 \times 10^8$ |
| Example 6 | $5 \times 10^{10}$ |
| Example 7 | $2 \times 10^7$ |

Results for Examples 3, 5 and 6 are shown in the graph of FIG. 6. Example 3 has the lowest resistivity and Example 5 is typical for the OC layer preferred in the current EPS process. The resistivity of Example 6, a prior OC, is too high for use in the EPS process below 50% relative humidity.

Chloride free material is preferred for the OC layer 32 for CRT applications. Example 7, the above-mentioned MS-905, comprising VIM and VP, is chloride free and comprises about 90 wt. % VIM and 10 wt. % VP. The resistivity of MS-950 is $3\times10^6$ ohms/sq. and $3\times10^8$ ohms/sq. at 60% and 30% relative humidity, respectively.

The OPC layer 34 is formed by overcoating the OC layer 32 with an organic photoconductive solution comprising a suitable resin, an electron donor material, an electron acceptor material, a surfactant and an organic solvent. When dry, the solution forms a volatizable, organic photoconductive layer. The resin utilized in the photoconductive solution is selected from the group consisting of polystyrene, poly-alpha-methyl styrene, polystyrene-butadiene copolymer, polymethylmethacrylate and esters of polymethacrylic acid, polyisobutylene and polypropylene carbonate. The electron donor material is selected from the group consisting of 1,4-di (2,4-methylphenyl)-1,4 diphenyl butatriene (2,4-DMPTB); 1,4-di(2,5-methylphenyl)-1,4 diphenyl butatriene (2,5-DMPBT); 1,4-di(3,4-methylphenyl)-1,4 diphenyl butatriene (3,4-DMPBT); 1,4-di (2-methylphenyl)-1,4 diphenyl butatriene (2-DMPBT); 1,4 diphenyl-1,4 diphenylphenyl butatriene (2-DPBT); 1,4-di(4-fluorophenyl)-1,4 diphenyl butatriene (4-DFPBT); 1,4-di(4-bromophenyl)-1,4 diphenyl butatriene (4-DBPBT); 1,4- di (4-chlorophenyl) -1,4 diphenyl butatriene (4-DCPBT); and 1,4-di (4-trifluoromethylphenyl)-1,4 diphenyl butatriene (4-DTFPBT). The electron acceptor material is selected from the group consisting of 9-fluorenone(9-F); 3-nitro-9-fluorenone (3-NF); 2,7-dinitro-9-fluorenone (2,7-DNF); 2,4,7-trinitro-9-fluorenone (2,4,7-TNF); 2,4,7-trinitro-9-fluorenrylidene malononitrile (2,4,7-TNFMN); anthroquinone (AQ); 2-ethylanthroquinone (2-EAQ); 1-chloroanthroquinone (1-CAQ); 2-methylanthroquinone (2-MAQ) and 2,1-dichloro-1,4 napthaquinone (2,1-DCAQ). The surfactant may be either silicone U-7602, available from Union Carbide, Danbury, Conn., or silicone silar-100, available from General Electric Company, Waterford, N.Y., and the solvents may be either toluene or xylene.

The following examples are intended to illustrate the OPC layer 34 of the present invention in greater detail, but not to limit it in any way.

OPC EXAMPLE 1

300 g (10 wt. %) of a polystyrene-butadiene copolymer resin, such as plitone-1035 available from Goodyear Tire and Rubber Co., Akron, Ohio, is added to 2648 g (about 88 wt. %) of toluene and stirred until the plitone is completely dissolved. Then, 50 g (1.66 wt. %) of an electron donor material, such as, tetraphenylbutatriene (TPBT) and 2.5 g (0.083 wt. %) of an electron acceptor material, such as, 2,4,7-trinitro-9-fluorenone (TNF) are added to the solution and stirred until all of the TNF is dissolved. 0.15 g (0.005 wt. %) of a surfactant, such as silicone silar-100 is added as the solution is stirred. When all the constituents are dissolved, the resultant solution is filtered through a series of cascade filters having openings ranging in size from 10μ to 0.5μ. The viscosity of the filtered photoconductive solution is 6 cp. This solution is similar to the solution described in U.S. Pat. No. 4,921,767 and is used as a control.

OPC EXAMPLE 2

The solution of OPC Example 2 is made in the manner described for OPC Example 1, and contains the following ingredients:

300 g (10 wt. %) of plitone-1035;
50 g (1.66 wt. %) of (2,4-DMPBT);
2.5 g (0.083 wt. %) of (TNF);
0.15 g (0.005 wt. %) of silicone silar-100; and
2648 g (balance) toluene.

After mixing and filtering through the cascaded filters, the viscosity of the solution is 7 cp.

OPC EXAMPLE 3

The solution for OPC Example 3 is made as described in OPC Example 1, and contains the following ingredients:

450 g (14 wt. %) of plitone-1035;
75 g (2.36 wt. %) of (2,4-DMPBT);
3.7 g (0.12 wt. %) of (TNF);
0.15 g (0.005 wt. %) of silicone silar-100; and
2648 g (balance) toluene.

The solution of Example 3 has a viscosity of 13 cp.

OPC EXAMPLE 4

The solution of OPC Example 4 is made as described in OPC Example 1 and has a viscosity of 30±2 cp. The viscosity is adjusted by adding a solvent suitable with the coating process. The ingredients of OPC Example 4 are as follows:

300 g (10 wt. %) of polystyrene (available from Amoco Co., Chicago, Ill., as Amoco 1R3P7);
50 g (1.66 wt. %) of (2,5 DMPBT);
2.5 g (0.083 wt. %) of (TNF);
0.15 g (0.005 wt. %) silicone silar-100; and
2648 g (balance) toluene.

OPC EXAMPLE 5

The solution of OPC Example 5 is made as described in OPC Example 1 and also has a viscosity of 28 cp. The ingredients of OPC Example 5 are as follows:

300 g (10 wt. %) of Polystyrene;
50 g (1.66 wt. %) of (2-DPBT);
2.5 g (0.083 wt. %) of (TNF);
0.15 g (0.005 wt. %) silicone silar-100; and
2648 g (balance) toluene.

OPC Example 6

The solution of OPC Example 6 is made as described in OPC Example 1 and has a viscosity of 30 cp. The solution includes the following ingredients:

300 g (10 wt. %) of Polystyrene;
50 g (1.66 wt. %) of (2,4-DMPBT);
2.5 g (0.083 wt. %) of (TNF);
0.15 g (0.005 wt. %) of silicone U-7602; and
2648 g (balance) toluene

OPC EXAMPLE 7

The solution of OPC Example 7 is made as described in OPC Example 1 and has a viscosity of 31 cp. The solution includes the following ingredients:

300 g (10 wt. %) Polystyrene
50 g (1.66 wt. %) of (2,4-DMPBT);
7.5 g (0.25 wt. %) of (2-EAQ);
0.15 g (0.005 wt. %) of silicone U-7602; and
2648 g (balance) toluene.

OPC EXAMPLE 8

The solution of OPC Example 8 is made as described in OPC Example 1, and has a viscosity of 30 cp. The solution contains the following ingredients:

300 g (10 wt. %) of Polystyrene;
50 g (1.66 wt. %) of (2,4-DMPBT);
2.5 g (0.083 wt. %) of (TNF);
7.5 g (0.25 wt. %) of (2-EAQ);
0.15 g (0.005 wt. %) silicone U-7602; and
2648 g (balance) toluene.

OPC EXAMPLE 9

The solution of OPC Example 9 is made as described in OPC Example 1, and has a viscosity of 29 cp. The solution includes the following ingredients:

300 g (10 wt. %) of Polystyrene;
50 g (1.66 wt. %) of (2,4-DMPBT);
2.5 g (0.083 wt. %) of (TNF);
7.5 g (0.25 wt. %) of (1-CAQ);
0.15 g (0.005 wt. %) of silicone U-7602; and
2648 g (balance) toluene.

OPC EXAMPLE 10

The solution of OPC Example 10 is made as described in OPC Example 1 and has a viscosity of 28 cp. The ingredients of the solution are as follows:

300 g (10 wt. %) Polystyrene;
50 g (1.66 wt. %) of (2,4-DMPBT);
7.5 g (0.25 wt. %) of (2-EAQ);
2.5 g (0.083 wt. %) of (TNF);
0.15 g (0.005 wt. %) of silicone U-7602; and
2648 g (balance) xylene.

While the ten listed examples of OPC solutions utilized a weight ratio of 6 parts resin to 1 part electron donor material, it has been determined that the ratio can vary from 8 parts resin and one part electron donor material to 2 parts resin, one part donor material. At the 8:1 ratio the photoconductivity of the solution is reduced, and at a ratio of 2:1 the formulation tends to become unstable, causing the electron donor material to begin to precipitate out of the solution. In order to optimize the sensitivity of the solution and the performance of the OPC layer produced therefrom, the ratio of resin to electron donor material preferably should be within the range of 6:1 to 4:1. It has been determined that the electron acceptor materials may be within the range of 0.05 to 1.5 wt. % of the total weight of the solution. All of the OPC solutions were diluted with either toluene or xylene, depending on the solvent used in the formulation of the solution, to obtain samples with viscosities of 12.5, 17.7, 24 and 28 cp. These OPC solutions were coated of 20 V (20 inch diagonal dimension) faceplate panels which were previously coated with a suitable OC layer. The preferred coating method for forming both the OC and OPC layers 32 and 34, respectively, is to "spin coat" by depositing a quantity of material and then spinning the panel to uniformly disperse the solution and create a layer of substantially uniform thickness. Typically, the OC layer 32 has a thickness of about 1μ, and the OPC layer 34 has a thickness that depends on the viscosity of the OPC solution. For example, the OPC layer thickness varied from 4μ, 6μ, 8μ, and 11μ, for viscosities of 12.5, 17.7, 24, and 28 cp. respectively. The optimum OPC layer thickness was found to be 5–6μ, which corresponds to a viscosity within the range of 15–20 cp. All OPC's produced good layers except for Examples 1 and 3, which showed defects in the OPC film which may be due to butadiene domains in the pliotone-1035.

The OC layers 32 produced using solutions formulated according to OC Examples 1–7 were evaluated by overcoating the OC layer with an OPC layer 34 to form a photoreceptor. The OPC layer made according to OPC Example 8 was selected as the standard for this test because the electron donor material, (2,4-DMPBT), is the most light sensitive of the donor materials tested and has low residual voltage after 10 light flashes, i.e., its light discharge characteristics are very good. Additionally, the 2,4-DMPBT-polystyrene film bakes out almost completely within 20 minutes, at 425° C. which is necessary in order to maximize light output from the screen. Finally, the electron acceptor (2-EAQ) used in OPC Example 8 has good solubility in toluene and is non-toxic. Sample slides using each of the OC Examples 1–7 were coated with OPC Example 8 and corona charged using a suitable charge device at a relative humidity of 50% and at a temperature of 23° C. The sample slides were measured for corona charging rate, in volts/second, rate of dark discharge, in volts/second, and for the voltage remaining on the photoreceptors after exposure to 1, 5 and 10 flashes from a xenon flash lamp. Dark discharge is defined as the surface voltage on the photoreceptor after standing in the dark for 90 seconds after the discontinuance of the corona charging. The test results are listed in TABLE 2.

TABLE 2

| OC Indent. | Charging Rate volts/sec | Dark Discharge Rate volts/sec | Exposure 1 | Voltage W/# of Flashes 5 | 10 |
|---|---|---|---|---|---|
| Example 1 | 18.5 | 1.5 | 217 | 128 | 73 |
| Example 2 | 17 | 1.3 | 230 | 139 | 77 |
| Example 3 | 20.2 | 1.1 | 200 | 110 | 54 |
| Example 4 | 17.5 | 1.5 | 220 | 130 | 78 |
| Example 5 | 16.6 | 1.5 | 240 | 148 | 85 |
| Example 6 | 7.5 | 1.0 | 180 | 160 | 100 |
| Example 7 | 22 | 1.0 | 240 | 120 | 50 |

Screen deposition characteristics were then determined for a number of photoreceptors utilizing the above-described OC solutions, each of which provided a conductive layer for an overlying OPC layer formed using the above-described solution, OPC Example 8. In this test, the photoreceptors comprising the OC and OPC layers were formed on the interior surface of 20 V faceplate panels which were corona charged using the charging apparatus described in Datta et al. U.S. Pat. No. 5,083,959, issued on Jan. 28, 1992. The electrical properties of the photoreceptors as well as the deposition characteristics of the photoreceptors to electrophotographically deposited screen structure materials are listed in TABLE 3. In TABLE 3, the charge acceptance of the photoreceptor is indicated as Vi and is the voltage measured on the surface of the photoreceptor after a 30 second corona discharge. The dark surface voltage, Vd, is the voltage on the surface after being held in the dark for 90 seconds. The exposure voltage, Vex, is the surface voltage on the photoreceptor after the panel containing the photoreceptor is exposed, through a shadow mask, to five flashes of a xenon lamp located within a lighthouse.

The latent charge image established after exposure was then developed with suitable black screen structure material in the manner described in co-pending U.S.

patent application Ser. No. 132,263, cited above. After the matrix was formed, the photoconductive layer was recharged, the shadow mask was reinserted and the photoreceptor was exposed for the deposition of the first of the three different color-emitting phosphors. The process was repeated for each color-emitting phosphor. The results, while subjective, are recorded in TABLE 3 as Deposition Characteristics.

TABLE 3

| | Panel Electrical Properties (volts) | | | Deposition Characteristics | | |
|---|---|---|---|---|---|---|
| OC Ident. | Vi | Vd | Vex | Matrix | Phosphor | Defects |
| Example 1 | 418 | 400 | 190 | good | good | none |
| Example 2 | 370 | 320 | 180 | good | good | few |
| Example 3 | 480 | 420 | 190 | good | excellent | none |
| Example 5 | 400 | 360 | 180 | fair | good | none |
| Example 6 | 140 | 125 | 45 | none | poor | many |
| Example 7 | 500 | 410 | 100 | good | excellent | none |

Figure 7:
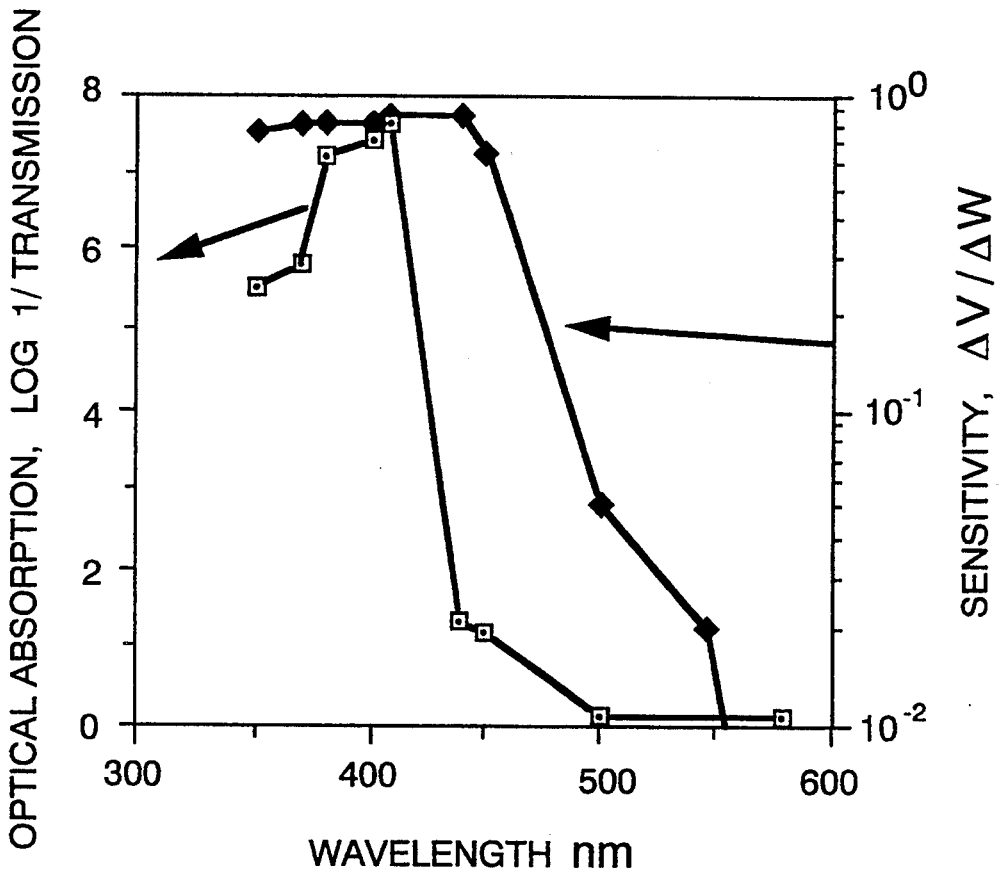
FIG. 7 is a graph of the optical absorption and the spectral sensitivity of a photoconductive layer overlying a conductive layer of the present invention.

The spectral sensitivity and the optical absorption of a photoreceptor formed on a glass slide and comprising an OC layer, made according to the formulation of OC Example 5, and an OPC layer, made according to the formulation of OPC Example 10, is shown in FIG. 7. The sensitivity was determined using a calibrated monochromator at different wavelengths. The photosensitivity of the photoreceptor is arbitrarily defined as the change in voltage divided by the exposure dose. Above 450 nm, the optical absorption of the protoconductive layer decreases rapidly and the sensitivity begins to decrease, with some photosensitivity observed to 550 nm, but not at longer wavelengths. The result confirms that low intensity yellow overhead lights (operating at a wavelength of ~577–597 nm) can be used in the EPS manufacturing facility to provide a safe working environment, without deleterious effect on panels coated with photoreceptors of the types described herein. Additionally, it has been established that the OC layer 32 has superior electrical and physical properties compared to prior conductive layers.

What is claimed is:

1. In a method of manufacturing a luminescent screen assembly on an interior surface of a faceplate panel for a color CRT comprising the steps of coating said surface of said panel with a conductive solution including a quaternary ammonium polyelectrolyte and a surfactant to form a volatilizable organic conductive layer, and overcoating said organic conductive layer with a photoconductive solution to form a volatilizable organic photoconductive layer, the improvement wherein said quaternary ammonium polyelectrolyte being a homopolymer selected from the group consisting of poly(dimethyl-diallyl-ammonium chloride); poly (3,4-dimethylene-N-dimethyl-pyrrolidium chloride) (3,4-DNDP chloride); poly(3,4-dimethylene-N-dimethylpyrrolidium nitrate)(3,4-DNDP nitrate); poly(3,4-dimethylene-N-dimethyl-pyrrolidium phosphate) (3,4-DNDP phosphate); and a copolymer of vinylimidazolium methosulfate and vinylpyrrolidone.

2. The method as described in claim 1, wherein said conductive solution further includes polyvinyl alcohol (PVA).

3. In a method of manufacturing a luminescent screen assembly on an interior surface of a faceplate panel for a color CRT, comprising the steps of:

a) coating said surface of said panel with an aqueous conductive solution including 2 to 6 wt. % of a quaternary ammonium polyelectrolyte and about 0.001 to 0.1 wt. % of a surfactant to form a volatilizable organic conductive layer;

b) overcoating said organic conductive layer with a photoconductive solution to form a volatilizable organic photoconductive layer;

c) establishing a substantially uniform electrostatic charge on said photoconductive layer;

d) exposing selected areas of said photoconductive layer to actinic radiation to affect the charge thereon;

e) developing said photoconductive layer with at least one dry-powdered, light emitting, triboelectrically-charged screen structure material;

f) fixing said screen structure material to said photoconductive layer to minimize its displacement;

g) filming said screen structure material;

h) aluminizing the filmed screen structure material; and i) baking said faceplate panel in air at a temperature of at least 425° C. to volatilize the constituents of the screen assembly, including said conductive layer and said photoconductive layer, the improvement wherein said quaternary ammonium polyelectrolyte being homopolymer selected from the group consisting of poly(dimethyl-diallyl-ammonium chloride); poly(3,4-dimethylene-N-dimethyl pyrrolidium chloride) (3,4-DNDP chloride); poly (3,4-dimethylene-N-dimethyl pyrrolidium nitrate)(3,4-DNDP nitrate); poly (3,4-dimethylene-N-dimethyl-pyrrolidium phosphate) (3,4-DNDP phosphate); and a copolymer of vinylimidazolium methosulfate and vinylpyrrolidone.

4. The method as described in claim 3, wherein said conductive solution further includes about 0.5 to 2 wt %, or less, polyvinyl alcohol (PVA).

* * * * *